United States Patent [19]

Weiss

[11] Patent Number: 4,720,268

[45] Date of Patent: Jan. 19, 1988

[54] COMPLIANT CONDUCTIVE PIN

[75] Inventor: Moses Weiss, Brooklyn, N.Y.

[73] Assignee: Industrial Electronic Hardware, New York, N.Y.

[21] Appl. No.: 29,212

[22] Filed: Mar. 23, 1987

[51] Int. Cl.[4] ..... H01R 13/41; H01R 13/428

[52] U.S. Cl. ..... 439/82; 439/751

[58] Field of Search ..... 339/17 C, 220 R, 220 A, 339/220 C, 220 L, 220 T, 221 R, 221 L, 221 M, 252 P; 439/82, 84, 743, 751, 825, 826, 827, 869, 870, 873; 29/874

[56] References Cited

U.S. PATENT DOCUMENTS

| | | | |
|---|---|---|---|
| 3,031,641 | 4/1962 | Camzi | 339/252 P |
| 3,391,567 | 7/1968 | Gregory | 72/367 |
| 3,545,080 | 12/1970 | Evans | 29/629 |
| 3,784,965 | 1/1974 | Murphy | 339/17 C |
| 3,805,214 | 4/1974 | Demler, Sr. et al. | 339/17 C |
| 4,345,373 | 8/1982 | Lacaze, Jr. | 339/258 R |
| 4,486,068 | 12/1984 | Ghigliotti et al. | 339/252 P |
| 4,596,437 | 6/1986 | Rush | 339/221 R |
| 4,641,910 | 2/1987 | Rozmus | 339/221 R |

FOREIGN PATENT DOCUMENTS

| | | | |
|---|---|---|---|
| 697725 | 11/1964 | Canada | 339/252 P |
| 69606 | 11/1958 | France . | |
| 690252 | 4/1953 | United Kingdom | 339/220 R |
| 820362 | 9/1959 | United Kingdom . | |

*Primary Examiner*—Gil Weidenfeld
*Assistant Examiner*—Gary F. Paumen
*Attorney, Agent, or Firm*—James & Franklin

[57] ABSTRACT

A compliant conductive pin for insertion in and making electrical connection with an internally conductively lined aperture is formed from a screw machine component by conventional machine tool operations; an axial bore is formed in the portion of the terminal to be received in the hole and material is removed from the sides of that portion sufficient to expose the internal aperture, thereby producing a fixed compliant beam in that portion.

9 Claims, 7 Drawing Figures

2b
2'
2a
2c 18
16
2a
12
14
2c
2b 4
18
2b
16
2a
12
23
14
2c
23
4

18
2b
16
2a
12
22
24
14
2c
20
22
26

FIG. 7
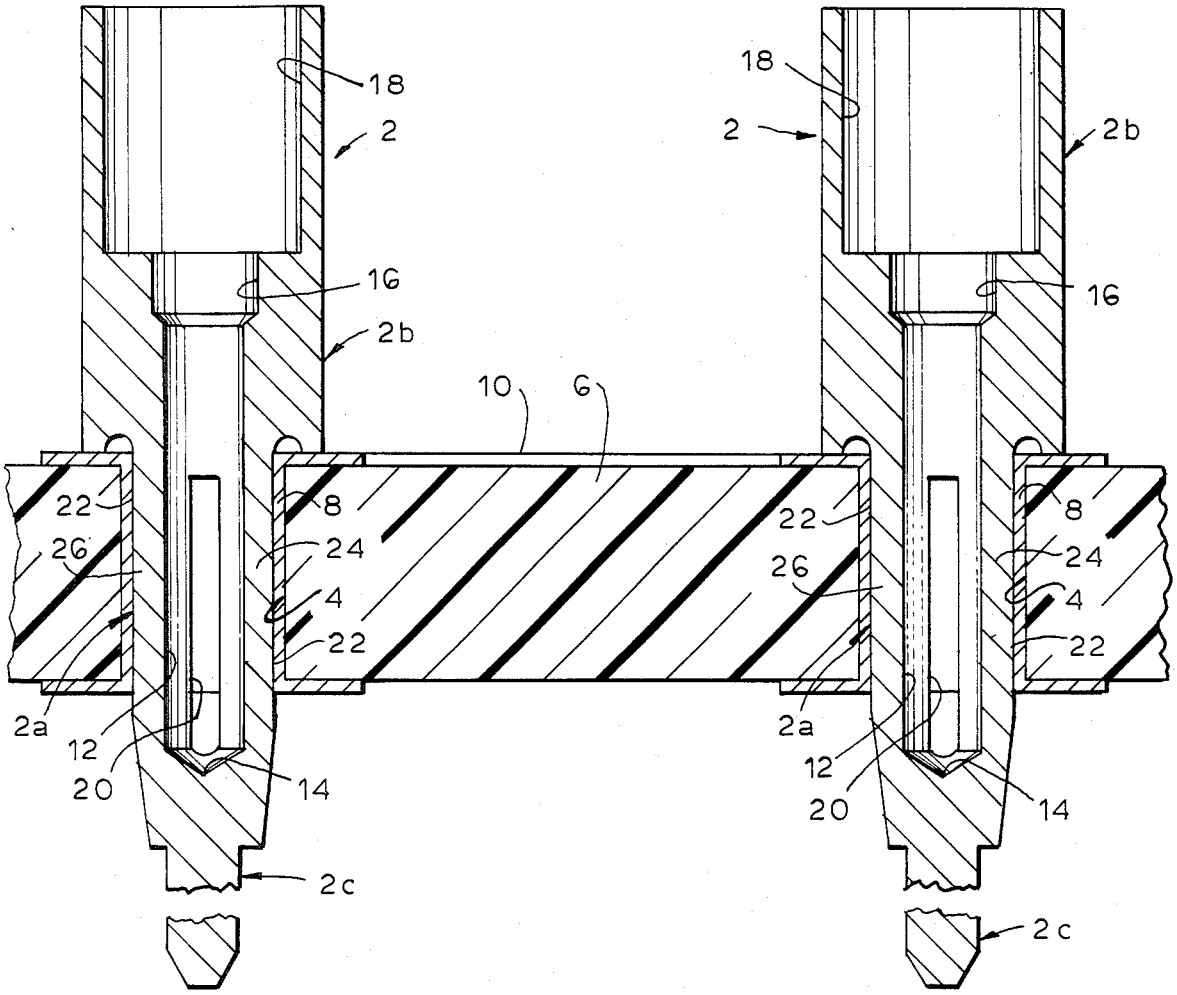
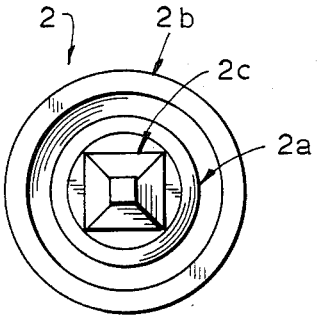
FIG. 5
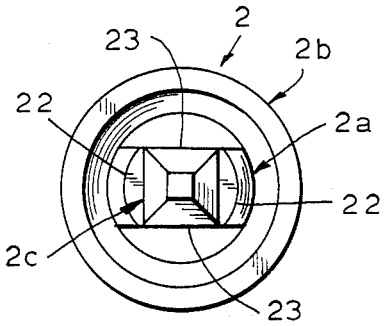
FIG. 6

COMPLIANT CONDUCTIVE PIN

The present invention relates to the construction of a conductive pin adapted to be inserted into a hole having a conductive inner surface so as to make reliable electrical connection with that inner surface, the pin being formed of a screw machine component modified by conventional machine tool operations.

Compliant terminals are designed for individual and/or group insertion into a circuit panel such as a printed circuit board having plated-through holes. Because of the compliance of the terminals, which produces significant pressure between the pin and the inner surface of the hole into which the pin is inserted, electrical connection and continuity is achieved without the need for additional joining methods such as crimping or soldering. It is necessary, if such terminal pins are to function satisfactorily, that they develop sufficient force for self-retention in the hole, that insertion and removal of the pin be accomplished without damage to the hole, and that the pins be capable of multiple insertions into the same or other plated-through holes.

Conventionally such pins are formed from flat stock which is appropriately cut and bent, the compliance of the pin, and hence the force which the pin exerts against the inside of the plated hole, being dependent in large part upon the thickness of the stock from which they are formed. The thicker the stock the greater the retention and electrical-connection-producing force, but the thicker the stock the more difficult are the cutting and shaping operations. Despite this inherent drawback, the industry has turned very largely to the use of compliant terminals made from such flat stock.

There is a type of contact well known to the trade which is made from screw-machined components. It goes under the trade name "Hypertac". Development of compliance in such contacts has received little, if any, attention by the industry, apparently because it has been felt that the use of screw machine components is inconsistent with the development of compliance. Gregory Pat. No. 3,391,567 of July 9, 1968 entitled "Electric Plugs" discloses a compliant pin of a different type which is largely screw-machine formed, but a significant non-screw machine bending step is involved, and the tip of the pin is slit, thus rendering the pin unreliable because mishandling can cause the tips to bend out and thus prevent insertion into the plated hole or cause damage to the plating in the hole. Lacaze Pat. No. 4,345,373 of Aug. 24, 1982, entitled "Method of Manufacture of Low-Cost, High Quality Low Insertion Force Electrical Connector Socket", discloses a connector which, while specifically different from that disclosed in the aforementioned Gregory patent, has the same procedural and functional disadvantages.

Evans Pat. No. 3,545,080 of Dec. 8, 1970, entitled "Method of Making Resilient Pins", teaches the formation of a compliant pin which does not have a slit tip from a cylindrical body rather than flat stock, but the fabrication of that pin involves significant non-screw-machine operations, particularly including the flattening of a portion of the cylindrical body, followed by cutting or shaping the body, and it is those non-machine-tool operations which produce that portion of the pin which actually presses against the interior of the plated hole. As a result the dimensions of the hole-engaging portions of the pin are subject to significant manufacturing variations, making for an impermissible non-uniformity in the pins produced thereby. Moreover, the compliance in the pins of that patent is produced by material which has been bent in the course of manufacturing, thus further working against uniformity and longevity.

It is the prime object of the present invention to provide a compliant pin, and a method for making it, which avoids the disadvantages of the prior art, and which, in particular, can be made in the necessary large quantities with a high degree of accuracy and uniformity in its dimensional and functional characteristics.

It is another object of the present invention to provide a compliant conductive pin which can be manufactured by machine tool operations and which requires no distortion of the initial blank from which the pin is formed.

It is a further object of the present invention to provide a compliant conductive pin the hole-engaging dimensions of which are achieved with uniformity and precision.

It is yet another object of the present invention to devise a compliant conductive pin which can be made from screw-machined parts without involving any straining or distortion of those parts.

It is a still further objective of the present invention to devise a compliant conductive pin which can be manufactured exclusively by operations which remove material but do not distort material.

To those ends, in the compliant conductive pin of my invention the surfaces which conductively engage the inside of the plated hole are the original outer surfaces of a screw-machine-produced part, and hence are precision-made. Those surfaces, when that part comes from the screw machine, form a portion of a cylindrical, and usually solid, body portion. That body portion is provided with a substantially axial bore which, when the part is initially solid, may be formed by a drilling operation, one which can readily be performed by automatic machine tools. Next a pair of opposed sides of that body portion are removed to a depth sufficient to expose the axial bore. This operation can be a conventional milling operation, also readily accomplished by automatic machine tools. The surfaces that are not removed by milling constitute the outer surfaces of the pin which conductively engage the interior of the plated hole, and their radial dimension is accurately and uniformly achieved in the original machine tool operation so as to be appropriate for the particular hole with which the pin is to be used. The length of the pin body portion where material has been removed and the axial bore exposed defines the compliant portion of the pin, and the depth to which the milling operation is carried out will control the degree of compliance, and hence the pressure exerted on the plating in the hole, without adversely affecting the hole-engaging dimension of the pin. Hence manufacture of the pin is convenient and inexpensive, its details can readily be tailored to the requirements for a particular installation, and the pins produced thereby will have superior functional characteristics.

To the accomplishment of the above, and to such other objects as may hereinafter appear, the present invention relates to the structure and the method of manufacture of a compliant conductive pin as defined in the appended claims and as described in this specification, taken together with the accompanying drawings in which:

FIG. 5 is a bottom plan view of the pin of FIGS. 1 and 2;

FIG. 6 is a bottom plan view of the pin of FIG. 4; and

FIG. 7 is a cross-sectional view showing two of the pins of the present invention inserted in plated holes of a circuit panel.

Figures 1, 2, 3, 4:
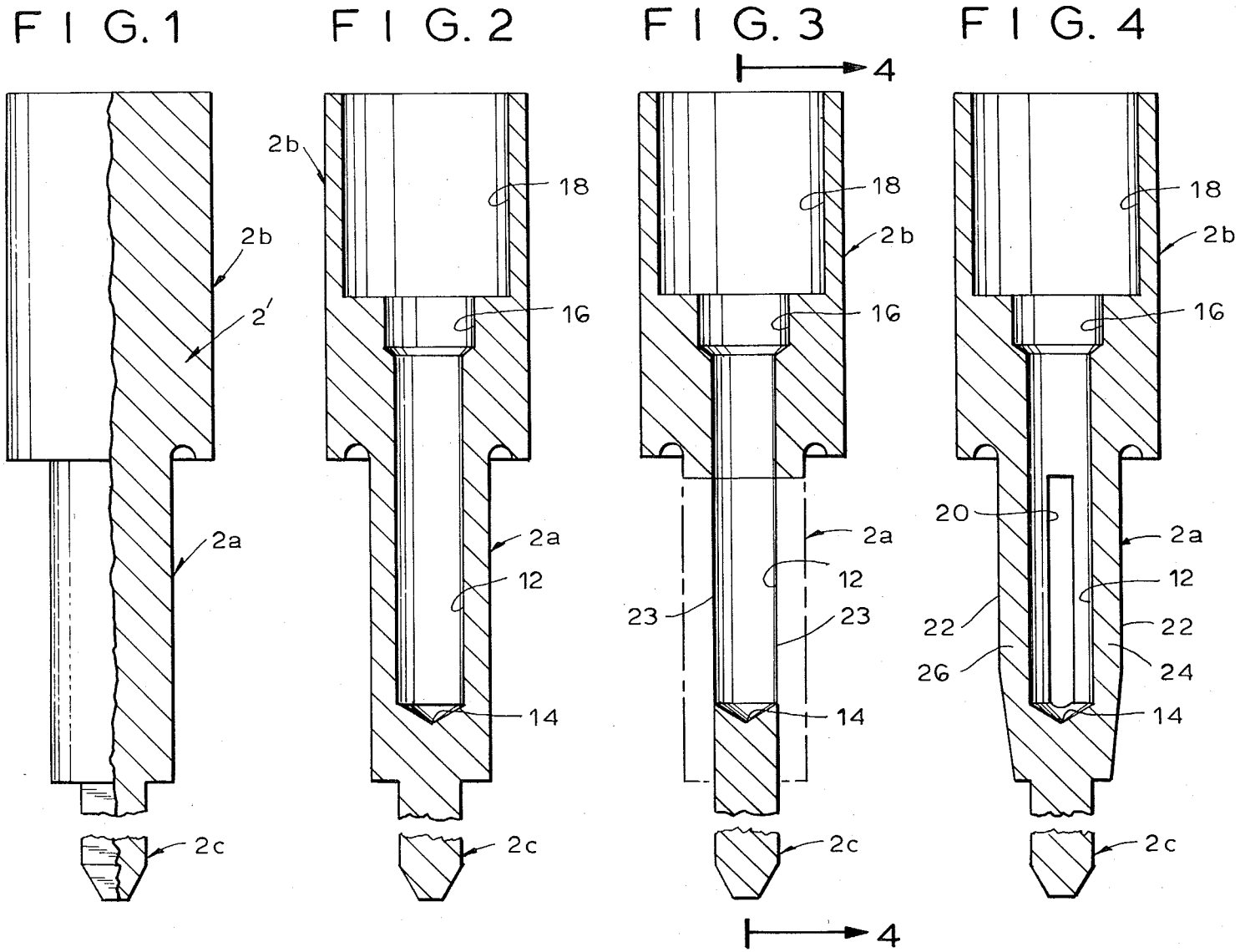
FIG. 1 is an elevational view, partially broken away in cross-section, of a typical screw machine part which may be used as the starting blank.
FIG. 2 is a view similar to FIG. 1 but in full cross-section after an axial bore has been formed therein.
FIG. 3 is a view similar to FIG. 2 but showing the pin after a milling operation has been performed on the two opposed sides visible in FIG. 2.
FIG. 4 is a cross-sectional view taken along the line 4—4 of FIG. 3.

My invention will be here specifically disclosed in connection with the formation of a conductive pin of a shape typical of the well known Hypertac pins, but it will be understood that this is by way of exemplification only, and that both the structure and method of my invention are adapted for use with other specifically different types of compliant pins.

As may be seen from FIG. 7, the conductive pins of the present invention, generally designated 2, are designed to be inserted into holes 4 formed in a circuit board 6, those holes being internally conductively lined, as by plating 8, which plating communicates with conductive strips or elements 10 on the circuit board 6. Electrical components of desired type or external conductors are adapted to be secured in known fashion to the pins 2. Because the body portions 2*a* of the pins 2 which enter the circuit board holes 4 press against, and therefore conductively engage, the through conducting lining 8, electrical connection is achieved between the pins 2 and whatever is electrically connected to them on the one hand and to the circuitry 10 on the circuit board 6 on the other hand. As is well known, the pins 2 are designed to be insertable and removable at will.

To make proper electrical connection without crimping, soldering or any other extra connecting operation or means, it is essential that the body portion 2*a* of a pin 2 firmly engage the plating 8 so as to achieve optimum electrical connection, but it is also essential that the outer dimension of the pin body portion 2*a* be accurately related to the inner dimension of the plating 8 so that insertion and removal of the pin 2 will not cause damage to the plating 8, it being understood that that plating is often quite thin and therefore fragile. Hence the pressure exerted by the pin body portion 2*a* on the plating 8 when the pin is inserted should be great enough to achieve optimum electrical connection and retain the pin 2 in position but should not be so large as to cause damage to the plating 8 attendant upon the insertion or removal of the pin 2.

In the pin 2 as here disclosed the body portion 2*a* which is received in the hole 4 is an intermediate body portion, surmounted by a body portion 2*b* of larger diameter and having a depending tip body portion 2*c* of smaller diameter. The body portion 2*b* functions in part to limit the degree to which the pin 2 is inserted in the hole 4, and the tip body portion 2*c* extends down from the hole 4 so that external electrical connections can be made thereto if desired.

To produce a compliant pin of that configuration, in accordance with the present invention, I start with the blank 2′ shown in FIG. 1, which as here specifically disclosed is a solid blank of conductive metal appropriately shaped by automatic screw machine operations so as to have the body portions 2*a*, 2*b* and 2*c*. The blank is cylindrical, and hence it can be formed exclusively by turning operations which automatic screw machines can perform with extreme accuracy, with great rapidity and at low cost.

Next, as shown in FIG. 2, the blank of FIG. 1 is axially bored from the upper end of the body portion 2*b* so as to produce in the body portion 2*a* the axial bore 12 which, it will be noted, terminates at 14, short of the lower end of the pin 2. Bores 16 and 18, of progressively larger diameter, may be formed in the upper end of the body portion 2*b* to produce a typical Hypertac configuration.

Next, as shown in FIGS. 3 and 4, and particularly the broken lines in FIG. 3, opposite portions of the body portion 2*a* are removed, as by conventional milling operations, to a degree sufficient to expose and make openings to the axial bore 12, those openings being indicated in FIG. 4 by the reference numeral 20. This forms a pair of opposite side surfaces 23 which are essentially planar and are spaced from one another by a distance substantially less than the diameter of the hole 4. Since the milling operation, as indicated by the broken lines in FIG. 3, is carried out only on two opposite sides of the body portion 2*a*, the exposed surfaces 22 of the body portion. 2*a* which are not removed by the milling operation retain their original curved shape and their original radial dimensions as achieved in the screw machine operation which produced the blank 2′. The body portion 2*a* is thus separated into two fixed beams 24 and 26 which have their ends fixedly connected together and which are the structural elements which actually engage the hole plating 8. The degree to which the milling operation is performed will determine the width of those beams 24, 26 and hence their strength and compliance, and this is done without altering or modifying the radius of their outer surfaces 22. The height to which material is removed by the milling step can also be varied, thereby to vary the axial length of the beams 24, 26.

Hence by the use of conventional machine tool operations—screw machine turning, drilling and milling—compliant pins are produced whose geometry, particularly including the radius of the hole-engaging outer surfaces, are accurately achieved in mass production, and with the degree of compliance likewise being accurately controlled through another conventional machine tool operation involving merely the removal of material and not the distortion of any remaining material. All of this can be done easily, reliably, quickly and inexpensively on the necessary large scale, but the inexpensiveness of production is, quite surprisingly, achieved without sacrificing, and indeed with enhancing, dimensional accuracy and functional efficacy and reliability.

While but a single embodiment of the present invention has been here specifically disclosed, it will be apparent that many variations can be made therein, all within the spirit of the invention as defined in the following claims.

I claim:

1. A conductive pin adapted to be inserted into a hole having a conductive inner surface, said pin comprising a body portion extending along an axis, one lateral dimension of said body portion being closely the same as the corresponding dimension of the hole, a second lateral dimension of said body portion substantially at right angles to said one dimension being less than said one dimension, said body portion having an axial bore and also having an opening completely laterally therethrough in the general direction of said second dimension and communicating with said bore, said opening extending axially along said body portion along a substantial proportion of that part of said body portion adapted to be received in said hole and having closed axial ends, said opening producing controlled resiliency in said body portion when received in said hole, thereby to maximize the electrical connection between said pin and said conductive hole surface.

2. A conductive pin adapted to be inserted into a hole having a conductive inner surface, said pin comprising an elongated body portion extending along an axis, said body portion having one pair of exposed side surfaces spaced from one another to produce a close fit within said hole, said body portion having an axial bore open at one end and also having an opening completely laterally through said body portion spaced from and between said side surfaces and communicating with said bore, said opening extending axially along said body portion along a substantial proportion of that part of said body portion adapted to be received in said hole, and said opening having closed axial ends, said opening producing controlled resiliency in said body when received in said hole, thereby to maximize the electrical connection between said pin and said conductive hole surface, said pin having a second pair of opposed side surfaces essentially orthogonal to said first pair of opposed side surfaces, said second pair of surfaces being spaced more closely to one another than said first pair of surfaces, and said lateral opening being open at and extending between said second pair of surfaces.

3. The conductive pin of claim 2, in which said first mentioned pair of opposed side surfaces are arcuate and said second pair of opposed side surfaces are generally planar.

4. The pin of any of claims 1, 2, or 3, in which said body portion is surmounted by a second body portion of larger diameter, said axial bore extending through said second body portion.

5. A conductive pin of any of claims 1, 2 or 3 in which said body portion is surmounted by a second body portion of larger diameter, and which said body portion has another body portion of lesser diameter extending down therefrom, said axial bore extending through at least said second body portion and being open only at the upper end of said second body portion.

6. The method of making a conductive pin adapted to be inserted into a hole having a conductive inner surface, said method comprising:

(a) Starting with a conductive body extending along an axis and having a cross-sectional shape transverse of said axis such as to have a first pair of opposed side surfaces spaced from one another to closely the same extent as the corresponding inner surfaces of said hole;

(b) forming in said body an axial bore extending from one end of said body between said first pair of side surfaces for a substantial distance toward, but terminating short of, the other end; and (c) removing material from a second pair of opposed side surfaces of said body other than said first pair at axial locations corresponding to at least a portion of said axial bore to produce side surfaces spaced from one another by a distance less than said first pair of said surfaces are spaced from one another, said material removing being continued to an extent such as to expose sides of said axial aperture.

7. The method of claim 6, in which said starting body has side surfaces, including said first pair of opposed side surfaces, which are arcuate, and in which said material removing step produces said second pair of opposed side surfaces which are substantially planar.

8. The method of claim 6, in which said starting body is screw-machine-formed and has an essentially cylindrical overall side surface, and in which said material removing step produces said second pair of opposed side surfaces which are substantially planar.

9. The method of claim 6, in which said starting body is screw-machine-formed and has an essentially cylindrical overall side surface, and in which said material removing step is a milling step and produces said second pair of opposed side surfaces which are substantially planar.

* * * * *